US009950895B2

(12) United States Patent
Weissbrod

(10) Patent No.: US 9,950,895 B2
(45) Date of Patent: Apr. 24, 2018

(54) WELDING WIRE COIL PACKAGING SYSTEM

(71) Applicant: LINCOLN GLOBAL, INC., City of Industry, CA (US)

(72) Inventor: Paul Weissbrod, South Euclid, OH (US)

(73) Assignee: LINCOLN GLOBAL, INC., City of Industry, CA (US)

( * ) Notice: Subject to any disclaimer, the term of this patent is extended or adjusted under 35 U.S.C. 154(b) by 547 days.

(21) Appl. No.: 14/582,246

(22) Filed: Dec. 24, 2014

(65) Prior Publication Data

US 2016/0001906 A1 Jan. 7, 2016

Related U.S. Application Data

(60) Provisional application No. 62/020,689, filed on Jul. 3, 2014.

(51) Int. Cl.

| | |
|---|---|
| ***B65B 63/04*** | (2006.01) |
| ***B65H 49/38*** | (2006.01) |
| ***B65H 54/547*** | (2006.01) |
| ***B65H 75/14*** | (2006.01) |

(Continued)

(52) U.S. Cl.

CPC ..... *B65H 49/38* (2013.01); *B65B 63/04* (2013.01); *B65H 54/547* (2013.01); *B65H 75/14* (2013.01); *B65H 75/248* (2013.01); *B65H 75/285* (2013.01); *B65H 2701/36* (2013.01)

(58) Field of Classification Search

CPC ..... B65B 63/04; B65D 85/04; B65H 16/04; B65H 18/026; B65H 49/04; B65H 49/06; B65H 49/08; B65H 49/20; B65H 49/36; B65H 49/38; B65H 54/54; B65H 54/543; B65H 54/547; B65H 55/046; B65H 75/24; B65H 75/248; B65H 75/285; B65H 2701/36

USPC .... 53/116; 242/163, 597, 597.8, 129, 129.7, 242/129.72, 577, 577.2, 577.3, 577.4

See application file for complete search history.

(56) References Cited

U.S. PATENT DOCUMENTS 1,949,378 A * 2/1934 Roehm ..... B65H 54/54 242/118.62

1,989,931 A 2/1935 Johnson (Continued)

FOREIGN PATENT DOCUMENTS

AU 538873 B 8/1984
AU 546682 B2 9/1985

(Continued)

OTHER PUBLICATIONS

Filament Winding, Springer, Handbook of Composities, 1982, pp. 449-478.

*Primary Examiner* — Stephen F Gerrity

(57) ABSTRACT

A welding wire coil packaging system including a process stand having an upright, the upright defining a hub receiver, the upright including a yolk supported on upright and spaced axially inward therefrom, and a cartridge including a shaft having a hub at one axial extremity, the hub being received in the hub receiver and at least partially supported on the yolk, a mandrel mounted on the shaft between a pair of end forms and adapted to receive a welding wire thereon in a coil winding process.

20 Claims, 20 Drawing Sheets

(51) Int. Cl.
*B65H 75/24* (2006.01)
*B65H 75/28* (2006.01)

(56) References Cited

U.S. PATENT DOCUMENTS

| | | | | | |
|---|---|---|---|---|---|
| 2,596,970 | A | * | 5/1952 | Adams | B65D 85/04 242/170 |
| 2,720,309 | A | | 10/1955 | Kimball | |
| 2,973,911 | A | | 3/1961 | Rayburn | |
| 3,395,308 | A | * | 7/1968 | Meyer | B23K 9/1333 219/137.7 |
| 3,457,962 | A | | 7/1969 | Shobert | |
| 3,672,586 | A | | 6/1972 | Morton | |
| 3,689,005 | A | | 9/1972 | Newman | |
| 3,695,529 | A | | 10/1972 | Hori et al. | |
| 3,731,888 | A | * | 5/1973 | Cassel et al. | B21C 47/28 242/129 |
| 3,747,746 | A | * | 7/1973 | Newman et al. | B65D 75/004 206/409 |
| 3,747,861 | A | | 7/1973 | Wagner et al. | |
| 3,748,817 | A | | 7/1973 | Newman | |
| 3,780,964 | A | * | 12/1973 | Gonzalez | B21C 47/16 206/403 |
| 3,796,305 | A | * | 3/1974 | Beason | B65D 85/04 206/407 |
| 3,803,796 | A | * | 4/1974 | Newman et al. | B65H 55/00 242/163 |
| 3,815,840 | A | * | 6/1974 | Horton et al. | B65H 75/24 242/571 |
| 3,915,301 | A | | 10/1975 | Gray et al. | |
| 3,919,827 | A | | 11/1975 | Larson et al. | |
| 3,982,712 | A | * | 9/1976 | Bassett | B65D 85/04 206/395 |
| 3,984,271 | A | | 10/1976 | Gilbu | |
| 3,985,315 | A | | 10/1976 | Newman | |
| 4,070,227 | A | | 1/1978 | Stuart | |
| 4,226,397 | A | | 10/1980 | Carlson | |
| 4,300,734 | A | | 11/1981 | Green et al. | |
| 4,317,546 | A | | 3/1982 | Grusa | |
| 4,348,439 | A | | 9/1982 | Jones | |
| 4,387,552 | A | | 6/1983 | Lancaster et al. | |
| 4,467,916 | A | | 8/1984 | Hedden et al. | |
| 4,541,222 | A | | 9/1985 | Joly | |
| 4,602,747 | A | | 7/1986 | Turk et al. | |
| 4,741,495 | A | | 5/1988 | Kotzur | |
| 4,993,650 | A | | 2/1991 | Nickell | |
| 5,131,538 | A | * | 7/1992 | Thibodeau | B65D 11/02 206/389 |
| 5,147,040 | A | | 9/1992 | Koike et al. | |
| 5,165,543 | A | * | 11/1992 | Heyda et al. | B65D 85/04 206/400 |
| 5,203,139 | A | | 4/1993 | Salsburg et al. | |
| 5,209,042 | A | | 5/1993 | Rickard | |
| 5,238,114 | A | | 8/1993 | Irozuru | |
| 5,291,823 | A | | 3/1994 | Kramps | |
| 5,400,567 | A | * | 3/1995 | Lindstrand | B65B 27/06 242/608.4 |
| 5,470,026 | A | | 11/1995 | Kotzur | |
| 5,499,775 | A | | 3/1996 | Vander Groef | |
| 5,660,024 | A | | 8/1997 | Ivanov et al. | |
| 5,678,778 | A | | 10/1997 | Kotzur et al. | |
| 5,724,787 | A | | 3/1998 | Diete | |
| 5,765,343 | A | | 6/1998 | Whittaker | |
| 5,803,397 | A | | 9/1998 | Chang | |
| 5,810,272 | A | | 9/1998 | Wallace et al. | |
| 5,921,499 | A | * | 7/1999 | Forsner | B65H 49/26 242/599.4 |
| 5,934,046 | A | | 8/1999 | Whittaker | |
| 5,938,260 | A | | 8/1999 | Wallace et al. | |
| 6,086,012 | A | | 7/2000 | Kotzur et al. | |
| 6,109,554 | A | | 8/2000 | Kotzur et al. | |
| 7,036,663 | B2 | | 5/2006 | Itkonen et al. | |
| 7,249,726 | B2 | | 7/2007 | Kotzur | |
| 7,356,976 | B2 | | 4/2008 | Tosa | |
| 8,056,717 | B2 | | 11/2011 | Weissbrod | |
| 8,191,337 | B2 | | 6/2012 | Moore | |
| 8,302,894 | B2 | | 11/2012 | Mercuri et al. | |
| D761,637 | S | * | 7/2016 | Weissbrod | D8/358 |
| 2001/0037955 | A1 | | 11/2001 | Pienta | |
| 2002/0005029 | A1 | * | 1/2002 | Morris et al. | B65D 85/04 53/461 |
| 2003/0014942 | A1 | * | 1/2003 | Kotzur et al. | B65B 25/24 53/116 |
| 2011/0030697 | A1 | | 2/2011 | Thompson | |
| 2011/0248112 | A1 | | 10/2011 | Corbett et al. | |
| 2011/0284682 | A1 | * | 11/2011 | Galgano et al. | B62B 1/14 242/596.8 |
| 2012/0056030 | A1 | * | 3/2012 | Shogren | B65H 54/103 242/476.1 |
| 2012/0110955 | A1 | | 5/2012 | Rekieta et al. | |
| 2014/0158802 | A1 | | 6/2014 | Batchelder et al. | |
| 2015/0259131 | A1 | * | 9/2015 | Weissbrod | B65D 85/04 206/408 |

FOREIGN PATENT DOCUMENTS

| | | | | | |
|---|---|---|---|---|---|
| CA | 1 126 712 | A | | 6/1982 | |
| CA | 2 068 686 | C | | 2/1999 | |
| CA | 2385620 | A1 | | 11/2002 | |
| CA | 2520484 | C | | 3/2006 | |
| CZ | 9800861 | A3 | | 6/1999 | |
| DE | 1 635419 | A1 | | 5/1972 | |
| DE | 27 17 647 | C3 | | 7/1981 | |
| DE | 2950278 | A1 | * | 7/1981 | B65H 75/285 |
| DE | 29 16725 | C2 | | 6/1988 | |
| DE | 3 813 162 | A1 | | 11/1989 | |
| DE | 39 12 852 | A1 | | 11/1989 | |
| DE | 93 04 380 | U1 | | 5/1993 | |
| DE | 44 05 187 | A1 | | 9/1994 | |
| EP | 0 005 355 | A2 | | 11/1979 | |
| EP | 0 018 565 | B1 | | 4/1984 | |
| EP | 0 313 781 | B1 | | 7/1990 | |
| EP | 0 514 334 | B1 | | 7/1995 | |
| EP | 0 760 228 | A1 | | 3/1997 | |
| EP | 0 761 540 | B1 | | 4/2000 | |
| EP | 1 655 225 | B1 | | 7/2008 | |
| EP | 1997761 | A2 | | 12/2008 | |
| EP | 2017211 | A1 | * | 1/2009 | B65H 49/325 |
| EP | 2 308 775 | A1 | | 4/2011 | |
| GB | 467 661 | A | | 6/1937 | |
| GB | 566341 | A | | 12/1944 | |
| GB | 579104 | A | | 7/1946 | |
| GB | 729932 | A | | 5/1955 | |
| GB | 814912 | A | | 6/1959 | |
| GB | 836312 | A | | 6/1960 | |
| GB | 1 141 832 | A | | 2/1969 | |
| GB | 1 207 185 | A | | 9/1970 | |
| GB | 1345226 | A | * | 1/1974 | B65B 63/04 |
| GB | 1 554 503 | A | | 10/1979 | |
| GB | 1 589 875 | A | | 5/1981 | |
| GB | 2069451 | A | * | 8/1981 | B65D 85/04 |
| GB | 2 045 716 | B | | 7/1983 | |
| GB | 2 083 002 | B | | 3/1985 | |
| JP | 58-027182 | B2 | | 6/1983 | |
| JP | 60167843 | A | * | 8/1985 | B65H 19/2292 |
| JP | 2000016699 | A | * | 1/2000 | B65H 49/08 |
| JP | 2004-106938 | A | | 4/2004 | |
| JP | 2009-23733 | A | | 2/2009 | |
| KR | 100207305 | B1 | | 7/1999 | |
| KR | 20040105196 | A | | 12/2004 | |
| NO | 155925 | C | | 6/1987 | |
| WO | 95/31373 | A1 | | 11/1995 | |
| WO | WO 0234647 | A1 | * | 5/2002 | B65H 49/305 |
| WO | W02013017694 | A1 | | 2/2013 | |
| WO | 2015/136354 | A2 | | 9/2015 | |

* cited by examiner

WELDING WIRE COIL PACKAGING SYSTEM

CROSS REFERENCE TO RELATED APPLICATION

This application claims priority to and the benefit of U.S. Provisional Patent Application Ser. No. 62/020,689, filed on Jul. 3, 2014, the disclosure of which is incorporated herein by reference in its entirety.

TECHNICAL FIELD

The present invention generally relates to a welding wire coil package. More particularly, the present invention relates to a welding wire coil packaging system that includes a stand on which components of the welding wire coil package are assembled.

SUMMARY OF THE INVENTION

The present invention provides a welding wire coil packaging system for a coil of wire including a processing stand, a hub rotatably supported on the stand, a welding wire coil supported on the hub, and at least one packaging component supported on at least one of the stand and the hub.

The present invention further provides a welding wire coil packaging system including a process stand having an upright, the upright defining a hub receiver, a cartridge including a shaft having a hub at one axial extremity, the hub being received in the hub receiver with the cartridge cantilevered from the upright; the cartridge including a mandrel on which welding wire is wound into a coil; a first end form and a second end form at opposite ends of the coil; and at least one packaging component extending from the first end form to the second end form and covering at least a portion of the coil.

The present invention further provides a welding wire coil packaging system including a process stand having an upright, the upright defining a hub receiver, the upright including a yolk supported on upright and spaced axially inward therefrom, and a cartridge including a removable shaft having a hub at one axial extremity, the hub being received in the hub receiver and at least partially supported on the yolk, a mandrel mounted on the shaft between a pair of end forms, the mandrel having an expanded position adapted to receive a welding wire thereon to form a coil that is open at each end, the end forms each defining an opening sized to fit over an end of the mandrel in the expanded position, and wherein the mandrel has a retracted position where the mandrel contracts to allow removal of the mandrel through an opening in one of the end forms; and a packaging element including a frame attachable to the end forms to support the coil after the mandrel and shaft are withdrawn.

According to one embodiment of the invention the processing stand of the welding wire coil packaging system is used to facilitate the winding process for creating the wire coil packaged described in U.S. patent application Ser. No. 14/272,448, which is incorporated by reference herein, or used in connection with other wire coil winding assemblies. The embodiment shown and described herein, therefore, should not be considered limiting. According to one embodiment, the processing stand is used during the winding process. According to another embodiment, the processing stand is used after the welding wire coil has been formed. In this embodiment, the processing stand is used to facilitate assembly of components used to package the welding wire coil.

In accordance with another aspect of the invention processing stand is used in the winding process. In this embodiment, one or more of the packaging components are provided before the winding process begins to create a winding cartridge on which the coil is formed. Packaging components are attached to the cartridge after the wire coil is formed to complete the welding wire coil package. This allows assembly of the cartridge off-line i.e. separate from the winding process, such that, as one coil is being wound and packaged, another cartridge may be assembled reducing down time attributable to assembly of the system in place at the winding assembly. In accordance with this embodiment, cartridge includes a hub that is attachable to the processing stand, where the hub supports one or more end forms to which external packaging components are attached after the coil is formed. Hub is rotatably supported on processing stand and removable therefrom.

According to another embodiment of the invention, a lift device is attached to cartridge to help load or unload the cartridge.

Figure 1:
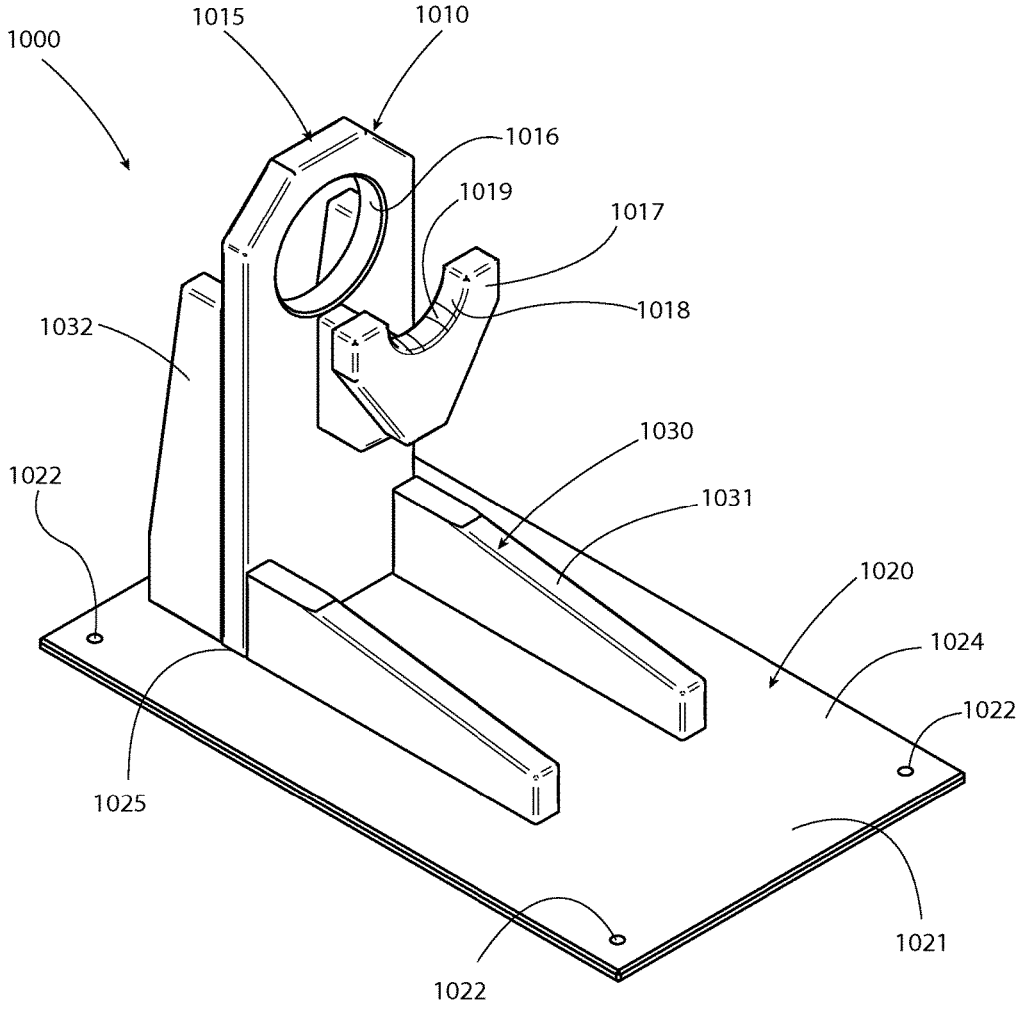
FIG. 1 is a perspective view of processing stand used in a welding wire coil package system according to the invention.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION OF THE INVENTION

As used herein, spatially orienting terms such as "above," "below," "upper," "lower," "inner," "outer," "right," "left," "vertical," "horizontal," "top," "bottom," "upward," "downward," "laterally," "upstanding," et cetera, can refer to respective positions of aspects as shown in or according to the orientation of the accompanying drawings. "Inward" is intended to be a direction generally toward the center of an object from a point remote to the object, and "outward" is intended to be a direction generally away from an internal point in the object toward a point remote to the object. Such terms are employed for purposes of clarity in describing the drawings, and should not be construed as exclusive, exhaustive, or otherwise limiting with regard to position, orientation, perspective, configuration, and so forth.

The present invention generally provides a welding wire coil packaging system, generally indicated by the number 1000. Welding wire coil packaging system includes a processing stand or simply a stand, generally indicated by the number 1010. Stand 1010 may be any structure that supports a welding wire coil C and one or more components 1001 (FIG. 18) used to package the coil C. Stand 1010, shown, includes an upright, generally indicated at 1015 that may be attached to a base 1020. Base 1020 may be any structure suitable for supporting upright including but not limited to a shop floor, a support plate, or a frame. In the example shown, base 1020 includes a mounting plate 1021 that is attached to a shop floor or other stationary structure capable of supporting the weight of the welding wire coil C when loaded onto stand 1010. Base 1020 may include receivers 1022 to facilitate attachment of the base 1020 to a supporting structure. For example, holes may be provided to receive fasteners at the periphery 1024 of plate 1021. Upright 1015 may be attached to plate 1021 with a fastener 1025 including but not limited to a weld, bolt, screw, clip, bracket and the like. To provide additional support a gusset assembly 1030 may be attached between upright 1015 and base 1020. In the example shown, gusset assembly 1030 includes at least one first gusset 1031 located inward of upright 1015 and at least one second gusset 1032 located outward of upright 1015. First gusset 1031 is a generally horizontally extending member having a lower surface 1033 that attaches to plate 1021 and a side surface 1035 that attaches to upright 1015. In the example shown, upright 1015 extends upward from base 1020 at a 90 degree angle causing lower surface 1033 and side surface 1035 of first gusset 1031 to be perpendicular. Second gusset 1032 is a generally vertically extending member having a lower surface 1034 that attaches to plate 1021 and a side surface 1036 that attaches to upright 1015. As in the case of first gusset 1031, lower surface 1034 and side surface 1036 of second gusset 1032 may be oriented perpendicular to each other. It will be appreciated that other angular relationships between upright 1015 and base 1020 and or between the surfaces of gussets 1031,1032 may be used to similar effect. The gusset assembly shown is not limiting as any gusset assembly that reinforces the upright 1015 and helps support it in a desired position may be used including but not limited to simple frame members, such as angle irons, gusset plates, and the like.

Figure 2:
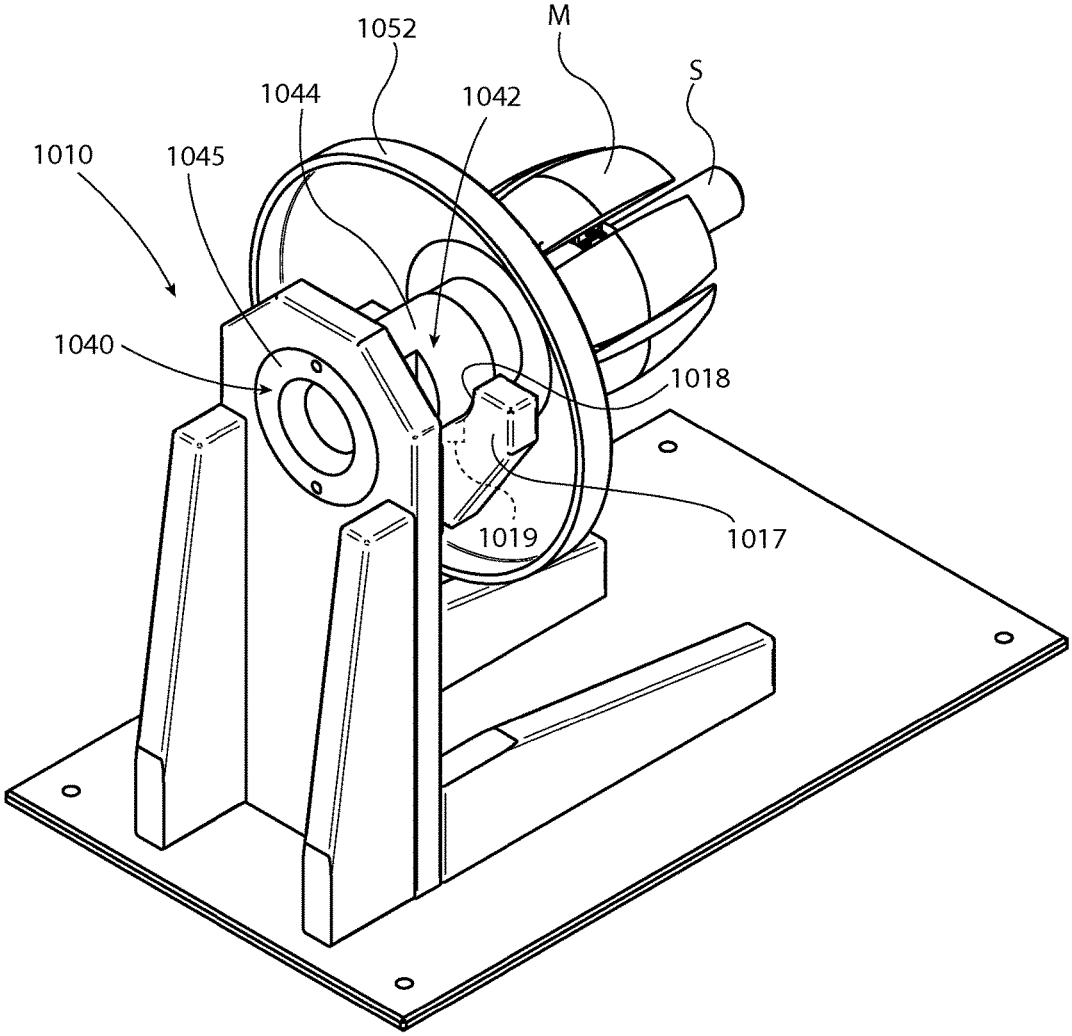
FIG. 2 is a perspective view of a welding wire coil packaging system according to the invention depicting a processing stand according to the invention with a partially assembled winding cartridge supported on the stand.

In the stand 1010 shown, a single upright 1015 is provided to support a wire coil in a cantilevered position. This allows free access to one end of coil C facilitating the packaging process as discussed in more detail below. It will be understood, however, that an additional upright may be used to provide support at opposite ends of the coil or other intermediate positions. The example shown, therefore, should not be considered limiting. In the example shown, upright 1015 includes a hub receiver 1016 that supports an end of a shaft S on which the coil C is supported. When stand 1010 is used in winding, as in the depicted embodiment, hub receiver 1016 may be made to rotatably support the shaft S. In the example shown, hub receiver 1016 is a circular opening formed in upright 1015. Additional support for shaft S may be provided including for example, a yolk 1017 located axially inward relative to hub receiver 1016. Yolk 1017 is shown supported on upright 1015, but may be supported on a separate support. Yolk 1017 defines a u-shaped receiver 1018 that is axially aligned with receiver 1016. Each receiver 1016,1018 may include a bearing package that engages the shaft S or component thereon to facilitate rotation of the shaft S. One bearing package 1019 is schematically shown in FIGS. 1 and 2. Bearing package 1019 is located on yolk 1017 beneath shaft S. Bearing package may include any suitable bearing including but not limited to a plain bearing, fluid bearing, magnetic bearing, or rolling element bearing.

Figure 3:
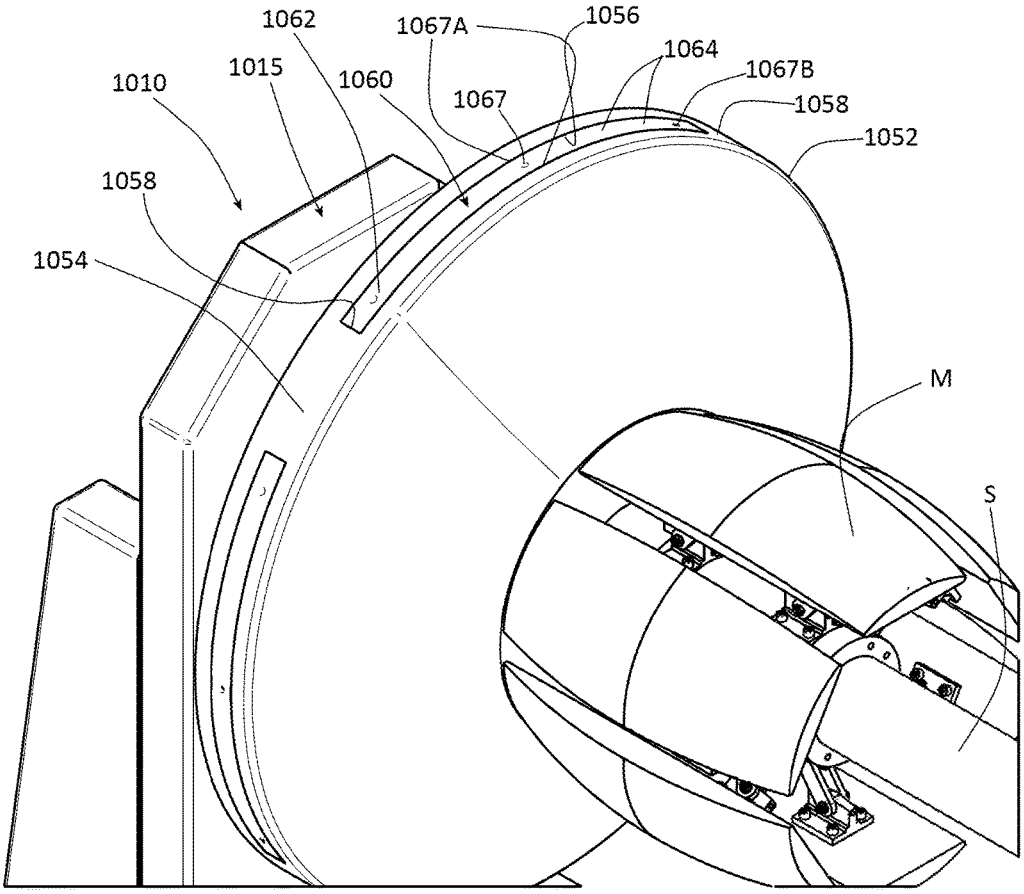
FIG. 3 is an enlarged perspective view similar to FIG. 2.

As best shown in FIG. 3, shaft S may have a wire winding mandrel M mounted thereon. Mandrel M may include retractable mandrel segments ($M_1$-$M_N$) that are actuated between a wire winding position and a retracted position that allows the mandrel M to be removed from the coil C once formed. A hub assembly 1040 may be attached to shaft S to mount shaft S on stand 1010. In the example shown, hub assembly 1040 includes a hub 1042 located axially outward from the shaft S. Hub 1042 includes a cylindrical outer surface 1044 received in yolk 1017 and rotatable within opening 1018. A flange 1045 may be formed axially outward of hub 1042 to fit within hub receiver 1016. As shown, flange 1045 has a larger diameter than hub 1042. Receiver 1016 is likewise of larger diameter than u-shaped receiver 1018. When loading the stand 1010, flange 1045 is located between yolk 1017 and upright 1015 allowing the hub 1042 to sit on yolk 1017 and then the hub assembly 1040 moved axially outward to locate flange 1045 within hub receiver 1016.

A cartridge generally indicated by the number 1050 is provided in preparation for winding and packaging. Cartridge 1050 generally includes at least one packaging component that is assembled before the winding process to facilitate assembly of the package after winding of the coil C has occurred. To facilitate winding, cartridge 1050 also includes a shaft S and mandrel M. With reference to FIGS. 2-6, assembly of a cartridge 1050 according to the invention is shown.

Figure 4:
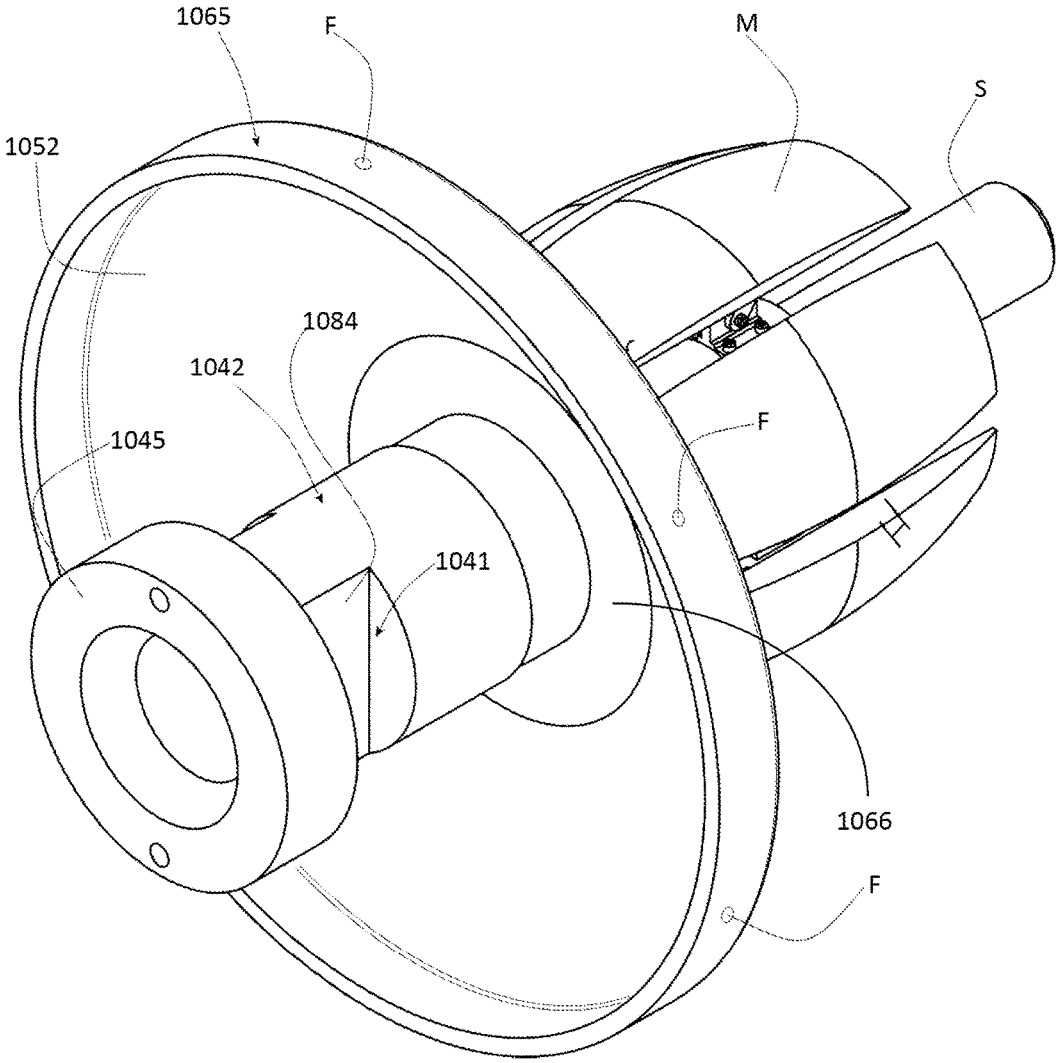
FIG. 4 is an enlarged perspective view similar to FIG. 3 showing installation of an end form cover.
Figure 4A:
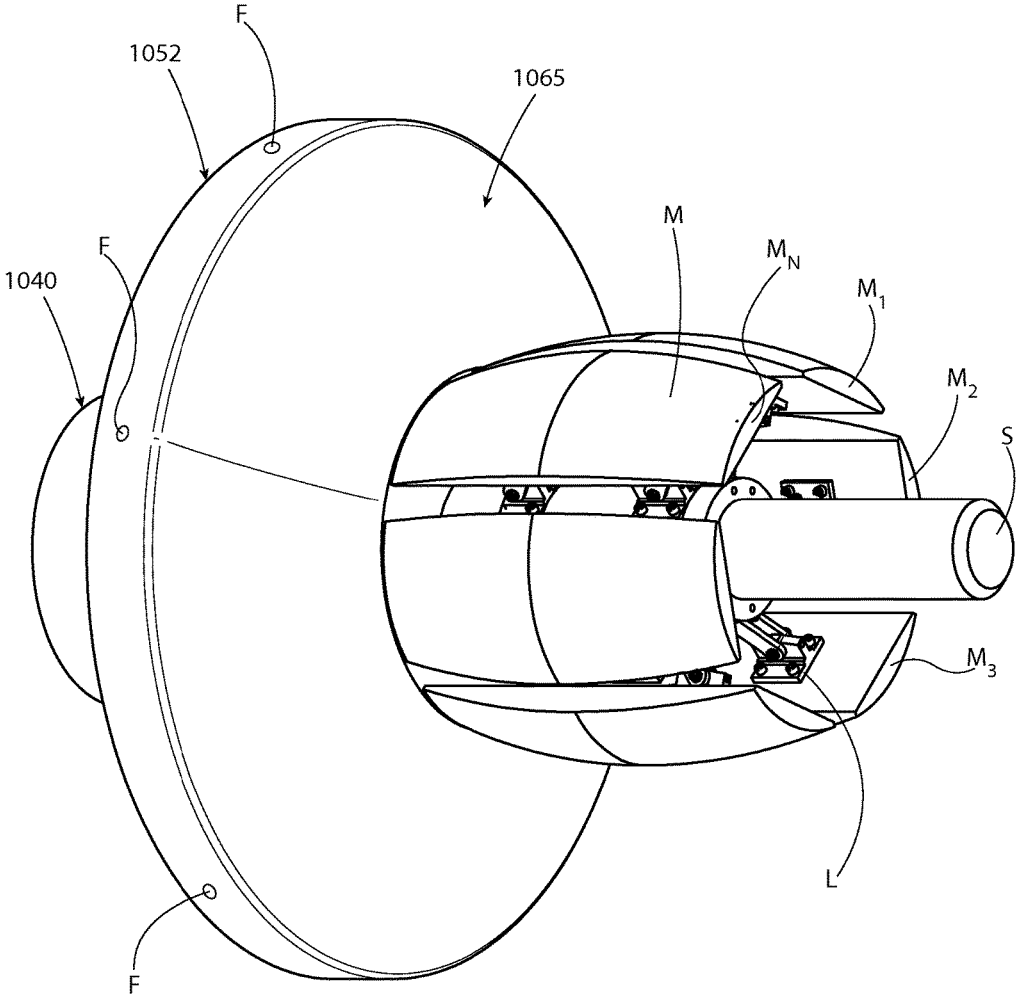
FIG. 4A is an enlarged perspective view similar to FIG. 4 showing details of the mandrel and end cover.
Figure 5:
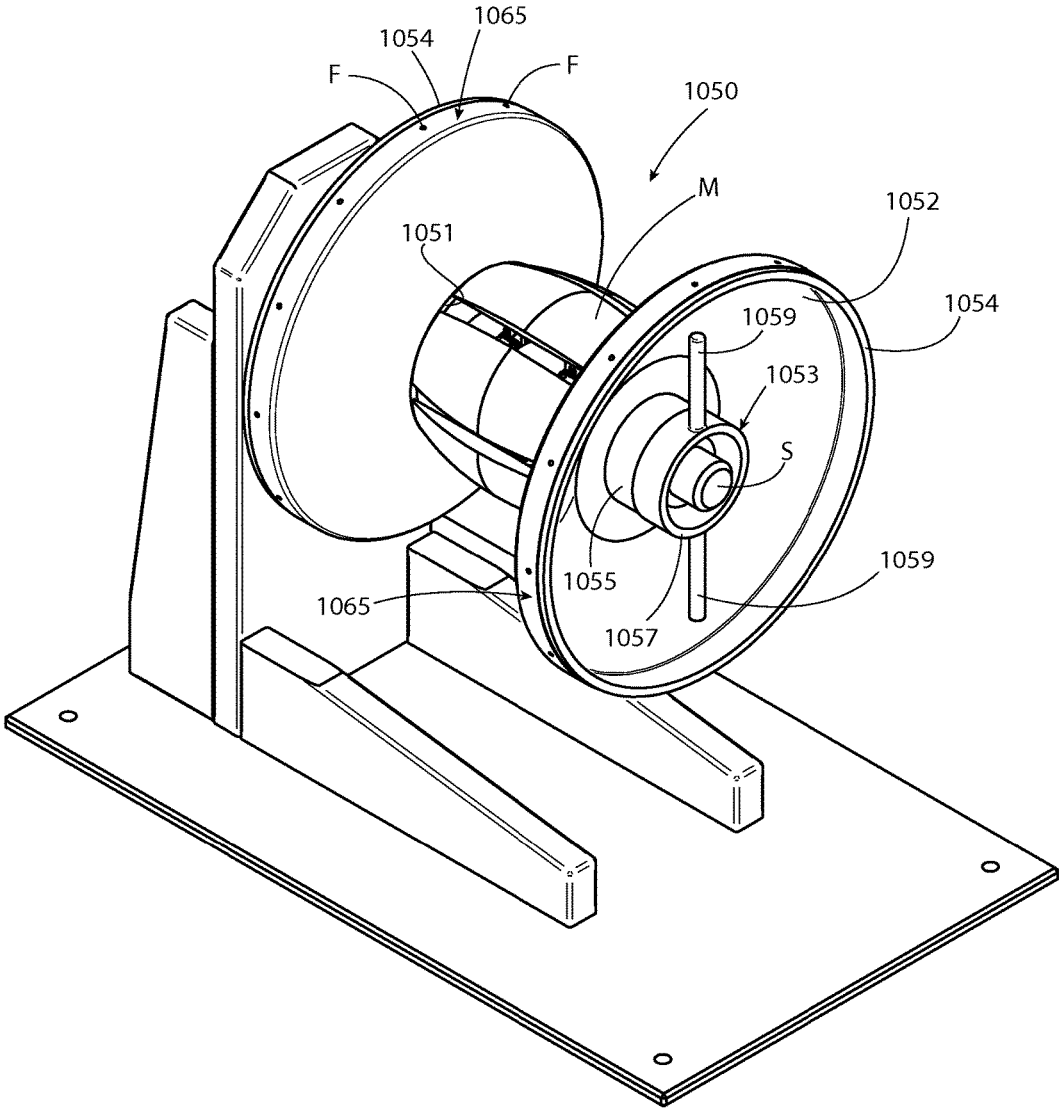
FIG. 5 is an enlarged perspective view similar to FIG. 5 showing a second end form and end form retainer installed.
Figure 6:
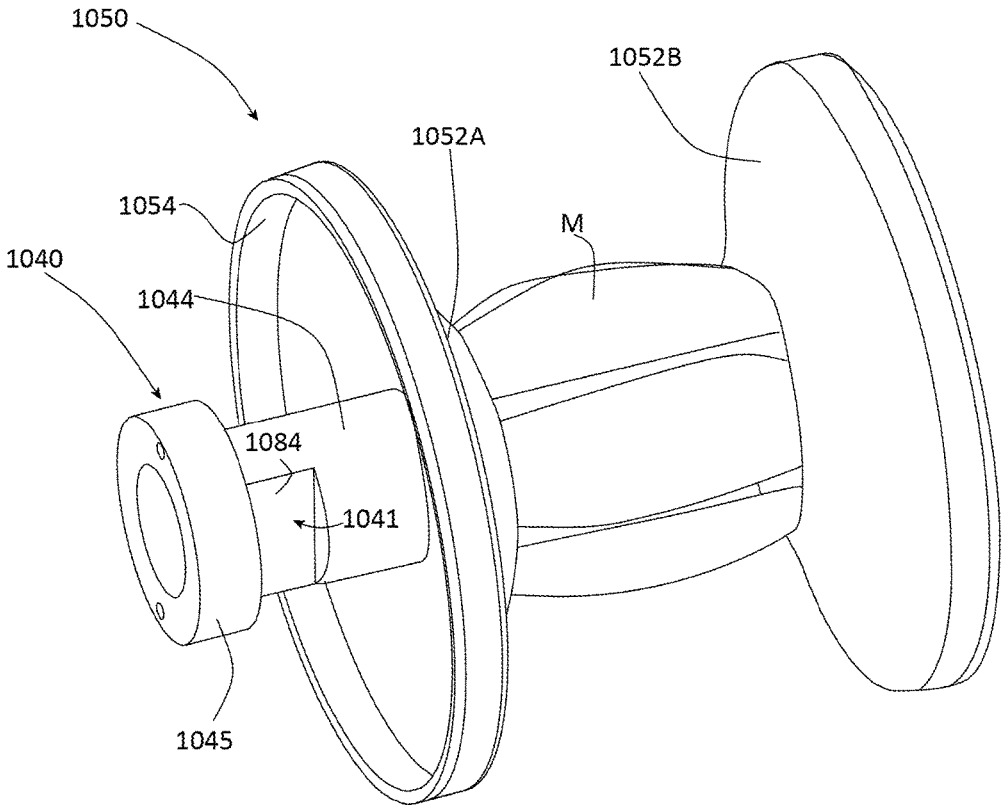
FIG. 6 is a perspective view of a cartridge according to the invention having a shaft with a mandrel and two end forms mounted thereon.

In the example shown, cartridge 1050 includes a pair of end forms 1052 that form the axial boundaries of the coil package, generally indicated at P in later figures. End forms 1052 are identical shapes and are place symmetrically on shaft S (FIG. 6). It will be understood that non-identical end forms may also be used. In the example shown, end forms 1052 are frusto-conical members that define a central opening 1051 that fits over an edge of mandrel M when in the expanded position. A first end form 1052A is located adjacent to hub assembly 1040. As best shown in FIGS. 4 and 4A, the hub 1042 may butt against end form 1052 to axially restrain end form 1052. With reference to FIG. 5, at the opposite end a retainer 1053 may be attached to shaft S to axially restrain the outer end form 1052B. Any suitable retainer 1053 may be used. In the example shown, a hat 1055 fits against end form 1052 and is held by a threaded collar 1057, which may be provided with a pair of diametrically opposed rods 1059 that facilitate tightening and loosening of the collar 1057.

Figure 16:
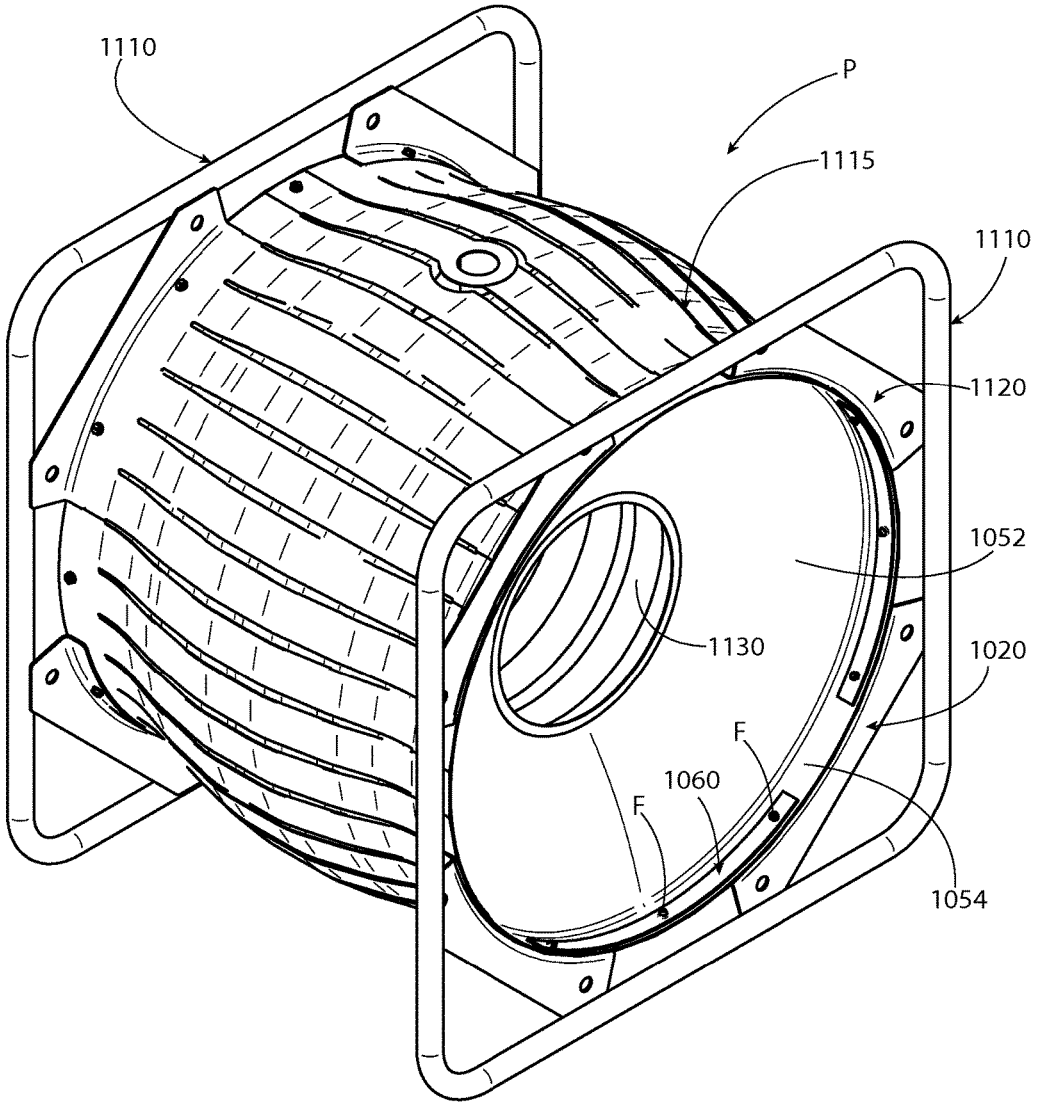
FIG. 16 is a perspective view similar to FIG. 15 showing removal of the package from the cartridge mandrel.

With reference to FIG. 3, end forms 1052 may optionally include a cylindrical rim 1054 that extends axially outward from mandrel M. Rim 1054 may define recesses or pockets 1056 that receive end frame attachment assemblies, generally indicated at 1060. Alternatively, as shown in FIG. 16, end frame attachment assemblies may be attached to an inner surface of rim 1054.

End frame attachment assemblies 1060 may include any surface that receives a fastener. It will be understood that these assemblies may be formed integrally with end form 1052 rather than using a separate assembly as discussed herein. In the example shown, end frame attachment assembly 1060 includes a band 1062 that is curved to match the circumference of rim 1054 and fit within pockets 1056. Pockets 1056 may include a tab, clip, lip, detent, or other band fastener 1067 that holds band 1062 within pocket 1056. Two possible band fasteners 1067 are depicted in FIG. 3. A pair of inward extending tabs 1067A are provided to grasp the edges of band 1062. The size of tabs 1067A is exaggerated to make them visible. The tabs 1067A are provided near the center of pocket 1056. Additional band fasteners 1067 are provided at the ends 1058 of pocket 1056 to hold the ends of band 1062. In these locations, a traditional fastener, such as, a flat headed screw 1067B is driven through the band 1062 and into the rim 1054 of end form 1052.

Band 1062 may include tapped openings or other fastener receivers 1064 thereon for attachment of corner plates as discussed more completely below. Alternatively, self-tapping fasteners may be driven into strips 1062 to attach corner plates. In the example shown, four frame attachment assemblies 1060 and four corresponding pockets 1056 are provided. The pockets 1056 and attachment assemblies 1060 are equally spaced about the circumference of the rim 1054.

A cover, generally indicated at 1065 in FIG. 4 is another packaging component that may be provided as part of the cartridge 1050. Cover 1065 mimics the shape of end form 1052 and fits over it to encapsulate the end form 1052 and hold strips 1062 within pockets 1056 during the winding process. Cover 1065 may be attached to end form 1052 with fasteners or by a lip that wraps around edge 1058 of rim 1054. Cover 1065 may be constructed of various materials including but not limited to metals, plastics, pulp materials and combinations thereof. In the example shown, cover 1065 is made of plastic and thermal formed to match the shape of end form 1052. As best shown in FIG. 4, cover includes a frusto-conical portion that fits over end form 1052 and has an annular flange 1066 that extends axially outward to cover rim 1054. Cover 1065 may be secured to end form 1052 by a fastener F including but not limited to a lip that fits over and grasps the end of rim 1054, tabs, clips, adhesives, welds, or screws (shown).

Figure 18:
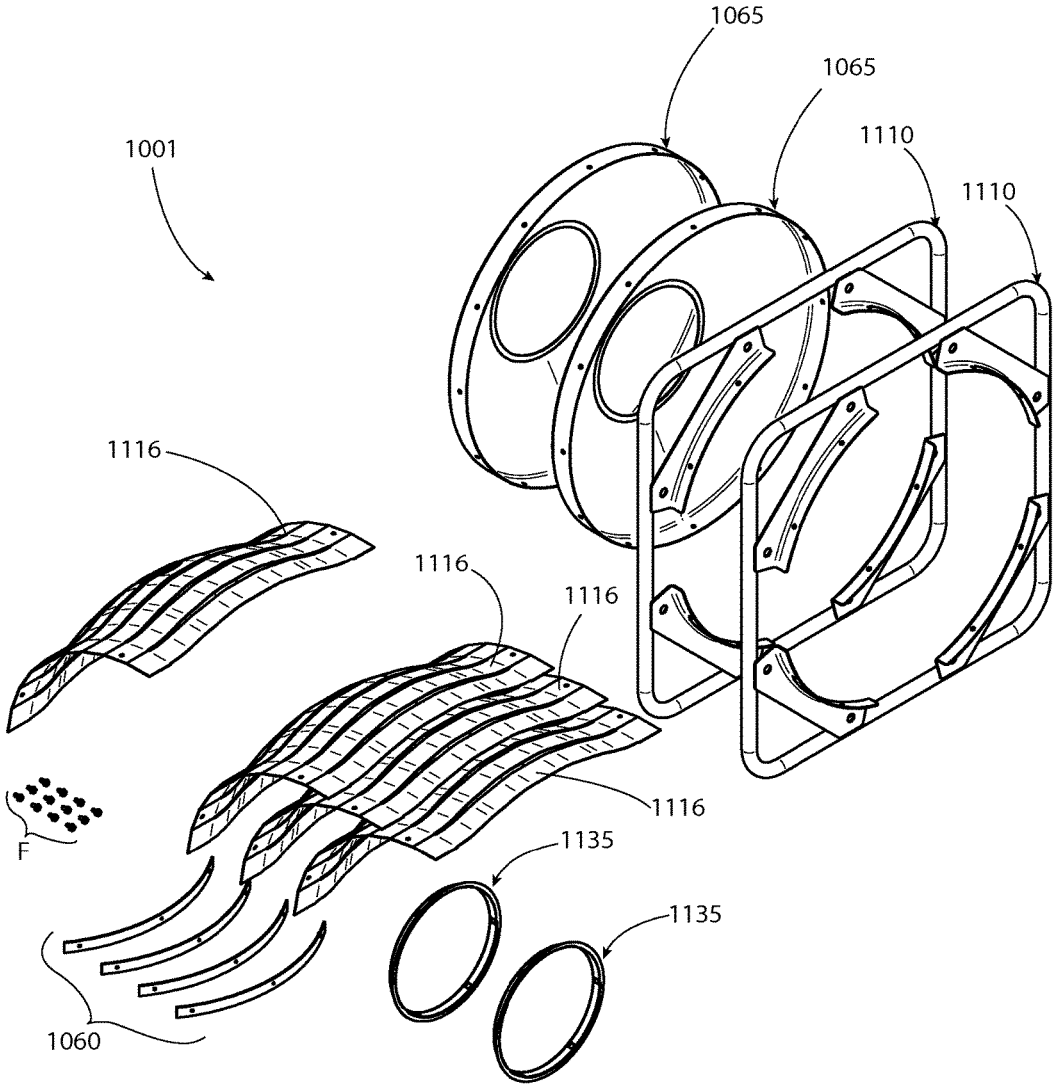
FIG. 18 is a perspective view of components used to package a coil according to the invention.

An assembled cartridge 1050 including a pair of end forms 1052 each having four attachment assemblies 1060 and a cover 1065 mounted thereon is shown in FIG. 18. As best seen in FIG. 5, cartridge 1050 may include the hub assembly 1040 extending from one side for cantilevered attachment to stand 1010. Alternatively, shaft S may extend from either side or two hub assemblies may be provided when cartridge is to be supported at both ends.

Figure 8:
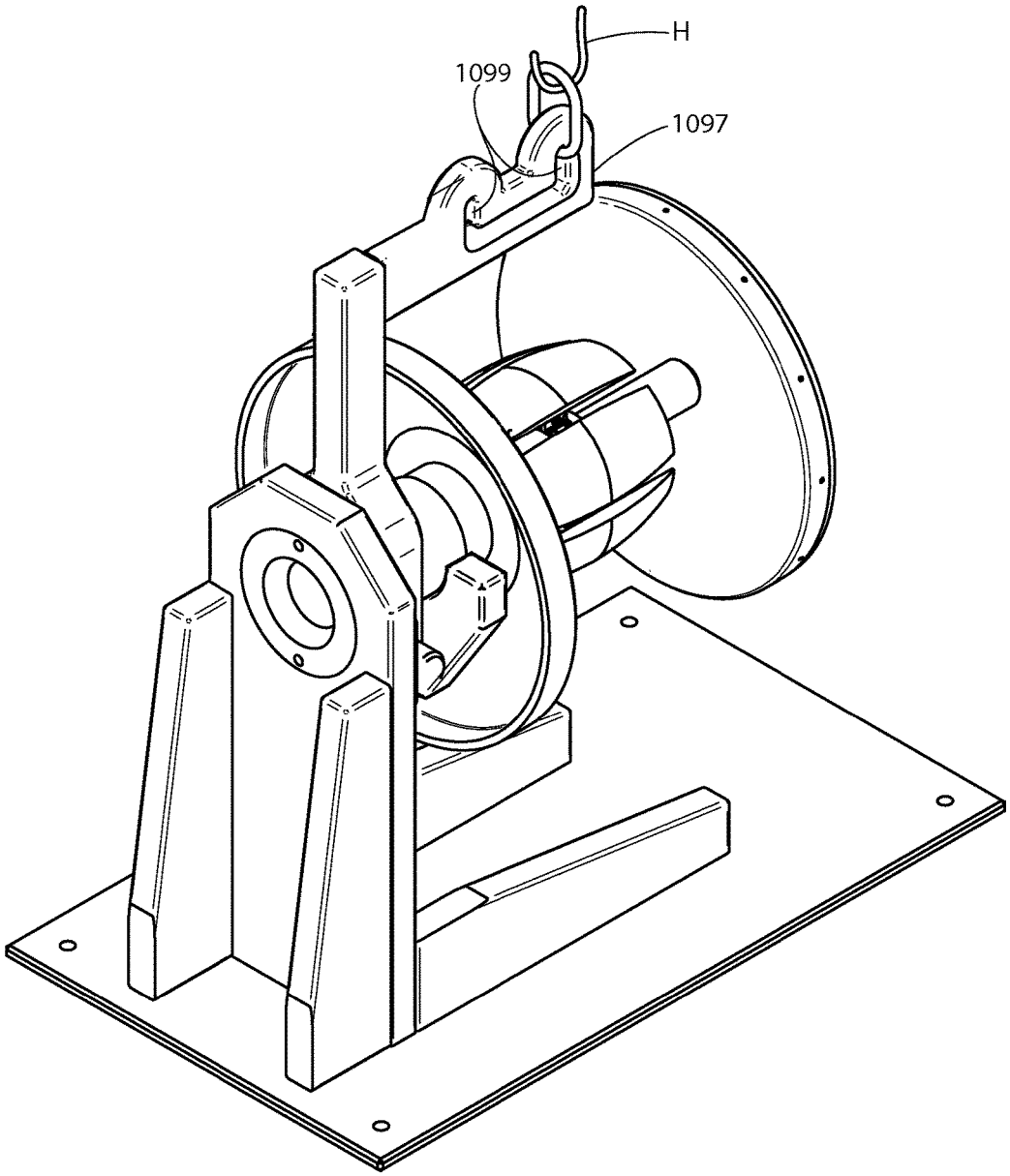
FIG. 8 is a perspective view similar to FIG. 7 showing the lifting device installing the cartridge on a stand.

According to one embodiment of the invention, a second cartridge could be assembled while the first cartridge is used in a winding process. In the example shown, a wound coil may contain upwards of 2200 lbs of welding wire. To that end, the cartridge 1050 may have significant weight empty given the robust nature of the components. With reference to FIG. 8, a lift device 1080 may be provided to help the user position the cartridge 1050 on stand 1020. Lift device is also designed to remove a full cartridge after the winding process is complete. Lift device 1080 may include any hanger or other bracket that attaches to cartridge 1050 and may be attached to a crane, gantry, fork lift, or other hoist H. In the example shown, to maintain the cantilevered end of cartridge 1050 exposed, lift device includes a fork 1081 having a pair of tines 1082 that are spaced from each other to receive a portion of hub assembly 1040 therebetween. As shown to prevent rotation of cartridge 1050 during transport, hub assembly 1040 may define one or more recesses 1041 that provide a flat surface 1084 (FIG. 6) to against which the tines 1082 bear. A pin, bolt or other retainer 1085 bridges the ends 1083 of tines 1082 to capture the hub assembly within tines 1082. This retainer 1085 is removable to allow the hoist attachment assembly 1080 to be removed after the cartridge 1050 is loaded on stand 1010 in preparation for winding and attachment of the packaging components after winding is complete. By the same token, lift device 1080 may then be easily reattached to lift the completed package from stand 1010 as discussed below.

An end 1086 of fork 1081 extends upward from the center 1088 of tines 1082 to a point radially outward of end forms 1052 and provide a clearance 1089 for the packaging components attached after the coil C formed. An arm 1087 extends axially inward from end 1086 beyond the center 1090 of cartridge 1050. Arm 1087 includes a hoist receiver 1095 that may include one or more hooking points 1092 for a hoist H. Hoist receiver 1095 is a elongated slot 1096 formed in an end 1097 of arm 1087. Hooking points 1092 may be a notch 1099 formed in the hoist receiver 1095. In the example shown, notches 1099 extend upward from a single slot 1096 so that tension from hoist H holds a hook, D-ring, carabineer or other link 1098 within the selected hooking point 1092 and once the tension is released, link 1098 may be slid in slot 1096 to another hooking point 1092. In this way, link 1098 may be moved selectively to one or more hooking points defined by hoist receiver 1095 for attachment to the hoist H.

Figure 7:
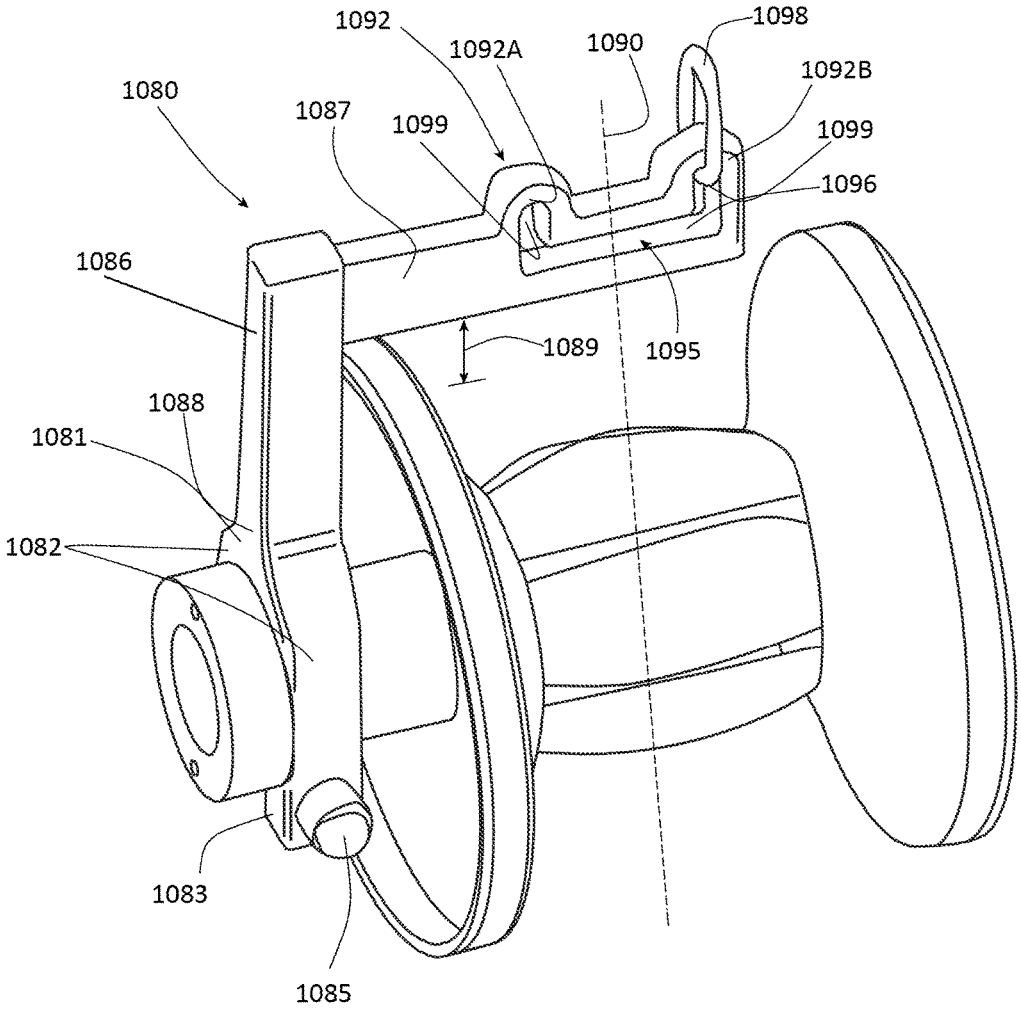
FIG. 7 is a perspective view similar to FIG. 6 with a lifting device attached to the cartridge.
Figure 7A:
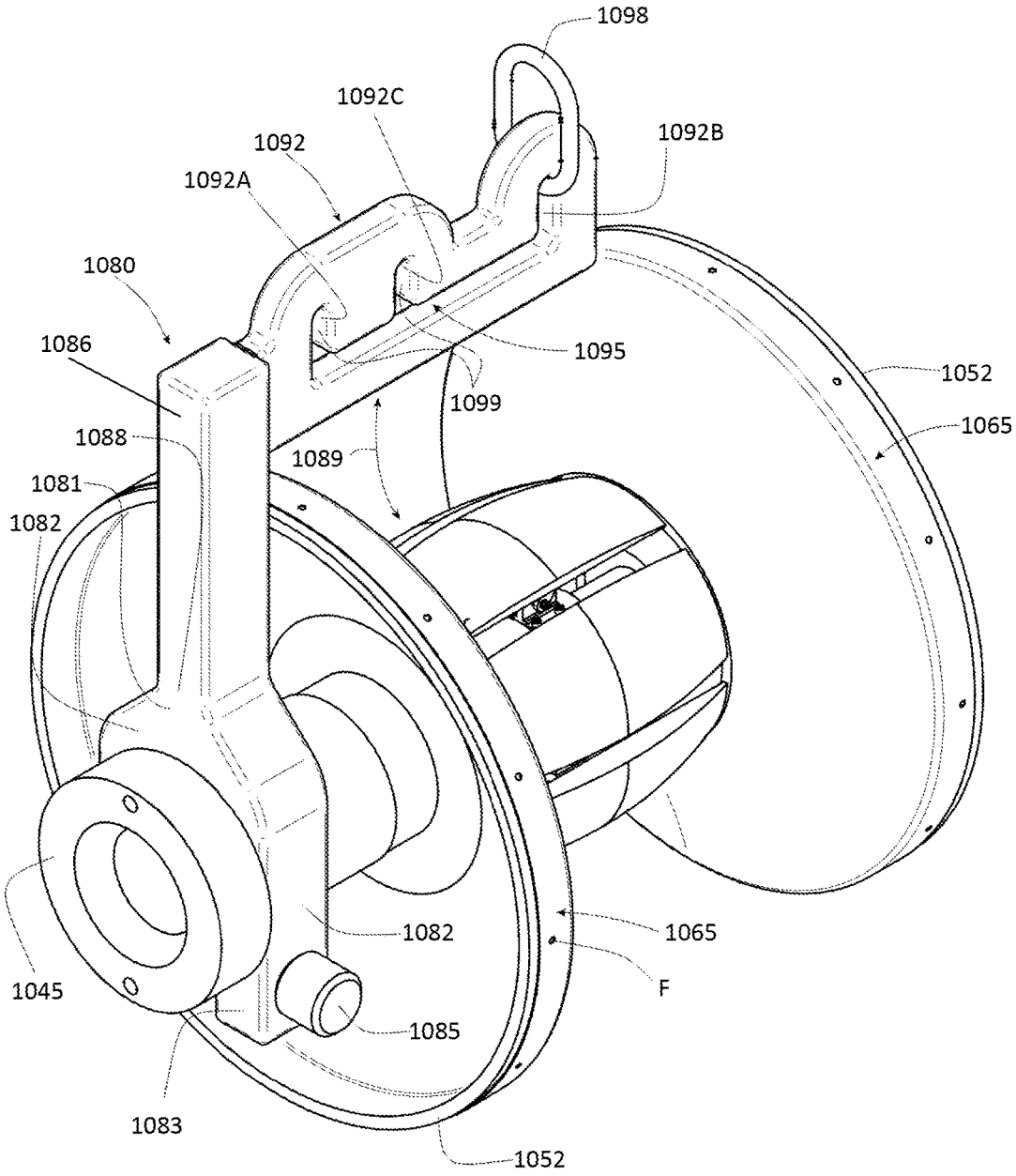
FIG. 7A is a perspective view similar to FIG. 7 showing an alternative lifting device.

In the example shown in FIG. 7, a pair of hooking points 1092A, 1092B are provided corresponding to lift positions where the coil is empty (1092A) and when the cartridge is full (1092B). A shown, first hooking point 1092A is located at the extremity of arm 1087 past the center 1090 of cartridge and second hooking point 1092B is located inward of center 1090. Hooking points may be upwardly extending recesses in which link 1098 is received and held by tension from hoist H. It will be appreciated that fewer or more hooking points may be provided than those shown. For example, FIG. 7A shows a lifting device 1080 having three hooking points 1092 where in addition to hooking points 1092A and 1092B at each end of slot 1095, a third hooking point 1092C is provided. Hooking point 1092C is located between hooking points 1092A and 1092B and may be aligned approximately with the center of the package 1050.

In addition, although arm 1087 is shown cantilevered from a single fork 1081, it will be understood that a second fork may be added at the opposite end of cartridge as well. With the lifting force provided by the hoist evenly divided over the two forks, a central hoist hooking point may be provided to lift the cartridge 1050 in both empty and full conditions.

Figure 9:
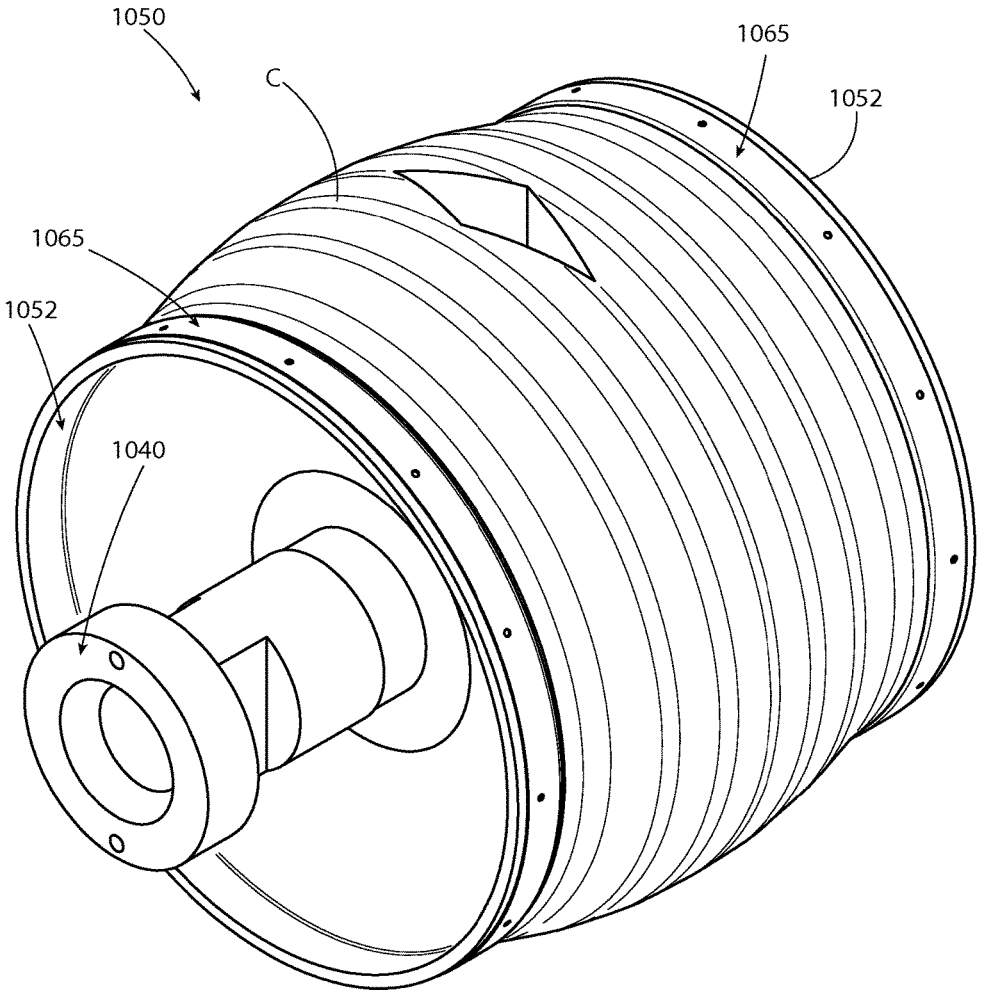
FIG. 9 is a perspective view of a full cartridge after a wire coil has been wound over mandrel between the end forms.
Figure 10:
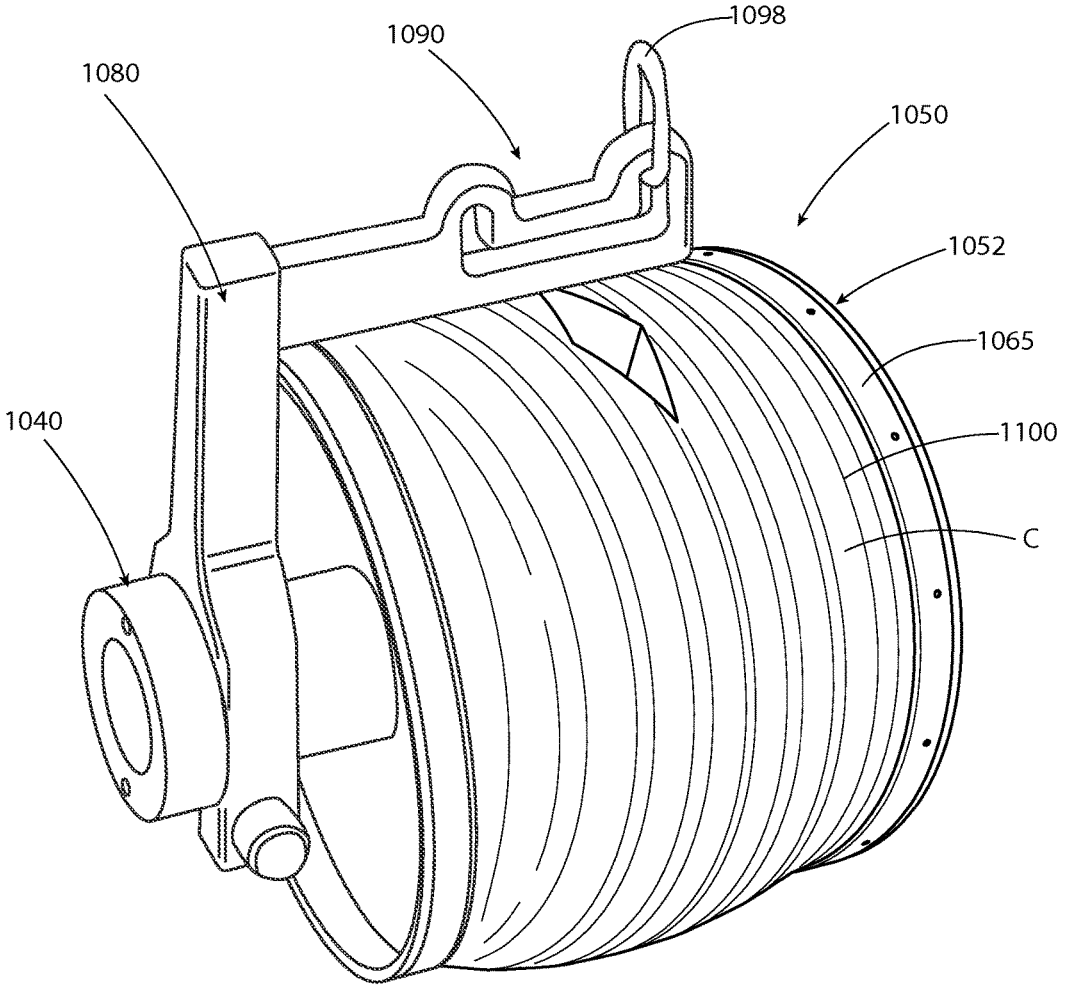
FIG. 10 is a perspective view similar to FIG. 9 with a lifting device installed to transport the full cartridge.
Figure 11:
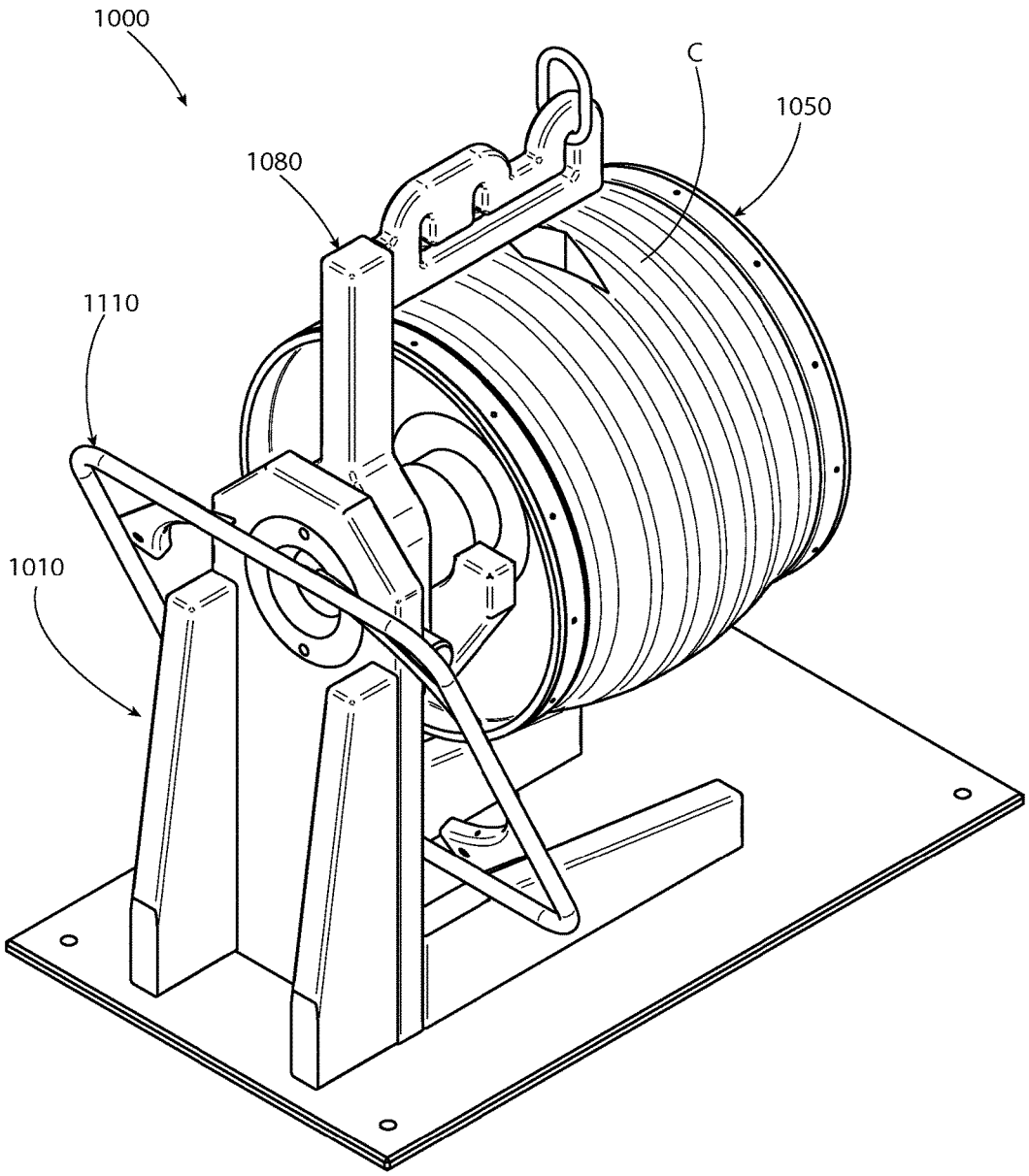
FIG. 11 is a perspective view showing a full cartridge loaded onto a processing stand staged for packaging.
Figure 12:
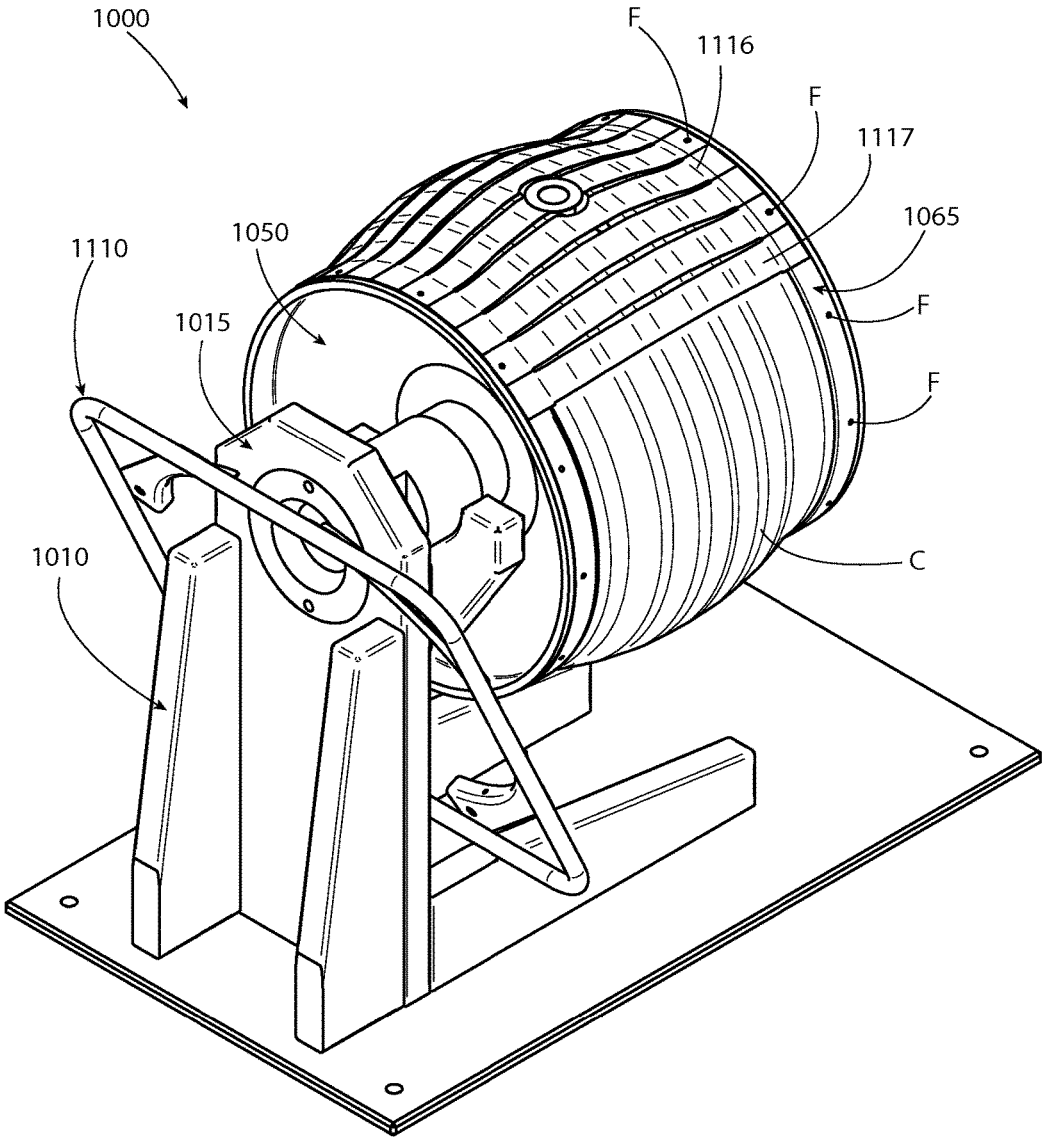
FIG. 12 is a perspective view similar to FIG. 11 showing partial assembly of a coil cover.
Figure 13:
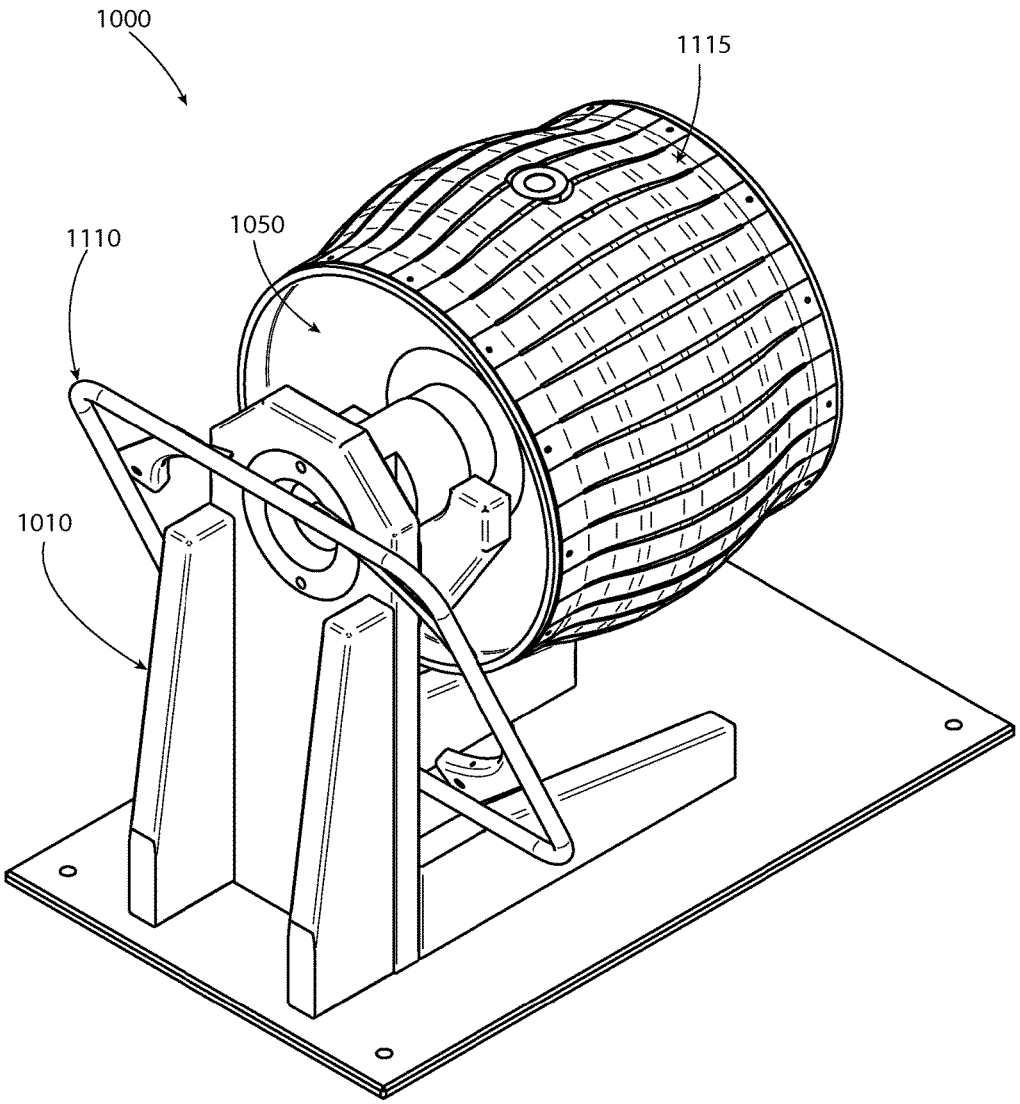
FIG. 13 is a perspective view similar to FIG. 12 showing the coil cover completely formed.

FIG. 9 shows a fully wound cartridge 1050 with an outer sheath 1100 of tape applied to the outer surface of coil C. FIG. 10 shows the hoist attachment assembly 1080 reattached to move the full cartridge from a winding assembly to a stand 1010 for application of the remaining package components. FIG. 11 shows a processing stand 1010 set up for packaging. As shown in FIG. 11, at least one packaging component may be supported on stand 1010 in anticipation of the full cartridge 1050 being loaded onto stand 1010. For example, an end frame 1110 is hung on gussets outward of upright 1015. End frame 1110 may have any form including the square tube frame form depicted in the drawings. In this example, end frame 1110 is supported in a position so that it does not interfere with loading of the cartridge 1050 on stand 1010. Once loaded, additional packaging components, such as a coil cover 1115 may be attached to end forms to cover coil C and provide axial support to package P. In the example shown, coil cover 1115 includes plural slats 1117 that are attached to end forms 1052 by any suitable fastener F such as those described in use with covers 1065. FIG. 12 shows the slats 1117 being successively attached to cover the coil C or cover segments 1116 comprising plural slats 1117 may be attached. In the example shown, four cover segments 1116 (FIG. 18) are attached about the coil C to form cover 1115. FIG. 13 shows all of the slats 1117 attached to form coil cover 1115.

Figure 14:
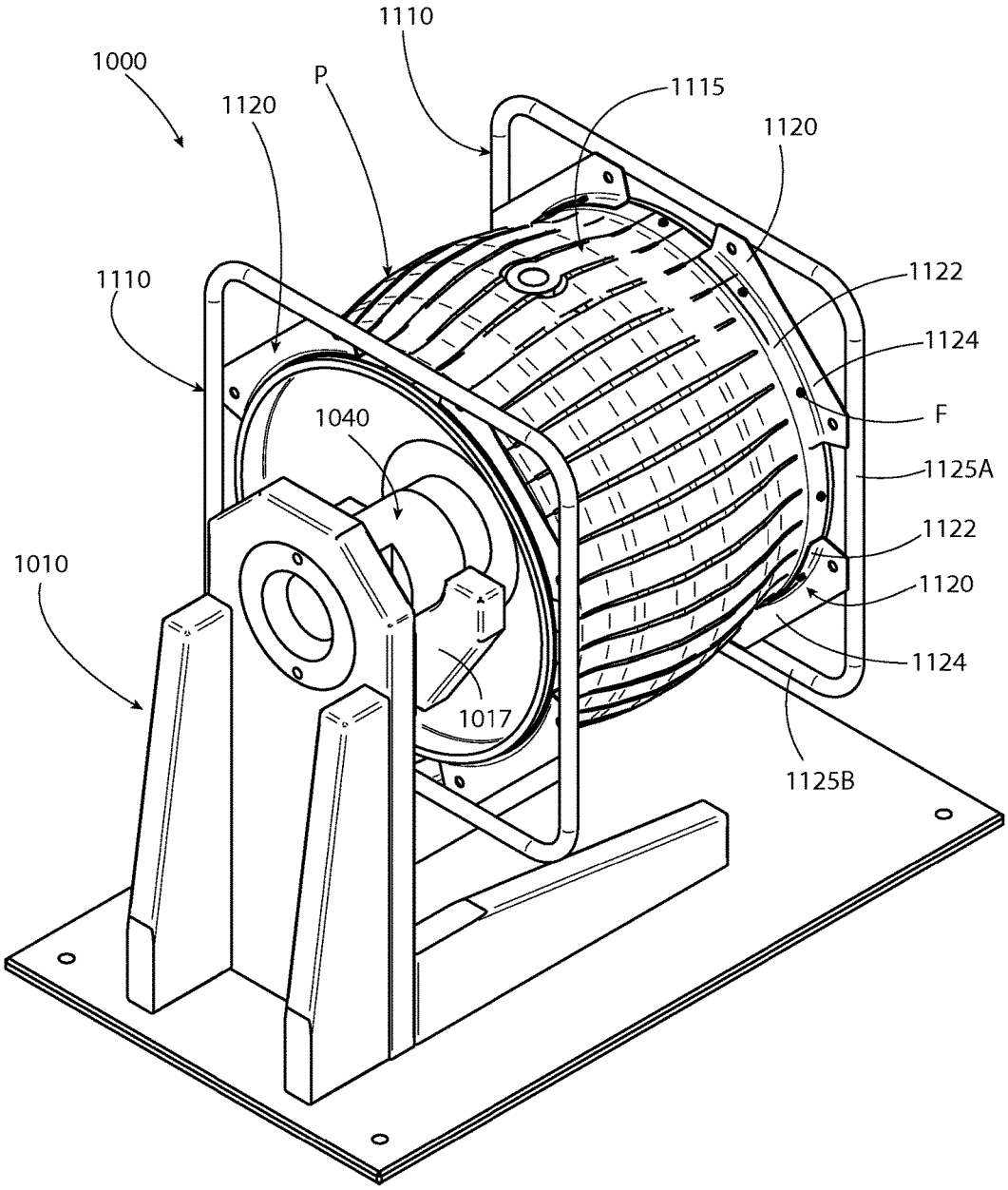
FIG. 14 is a perspective view similar to FIG. 13 showing installation of the end frames.

As shown in FIG. 14, with the cover 1115 complete, end frame members 1110 may be attached by fastening corner supports 1120 on end frame members 1110 to attachment assemblies 1060 described above. In the example shown, corner supports 1120 each include a support base 1122 that conforms to the circumference of end form and is fastened to end form at attachment assemblies. A corner gusset 1124 extends radially outward from base 1122 to attach to one or more frame members 1125 of end frame 1110. In the example shown with a square shaped end frame formed from four frame members 1125, the corner gussets span adjacent frame members attaching to a first frame member 1125A at one end and a second frame member 1125B at an opposite end. Attachment may be accomplished by any fastener F including but not limited to a weld, a bolt, a clip, band, or self-tapping screw or other fasteners described in connection with cover 1065 above.

Figure 15:
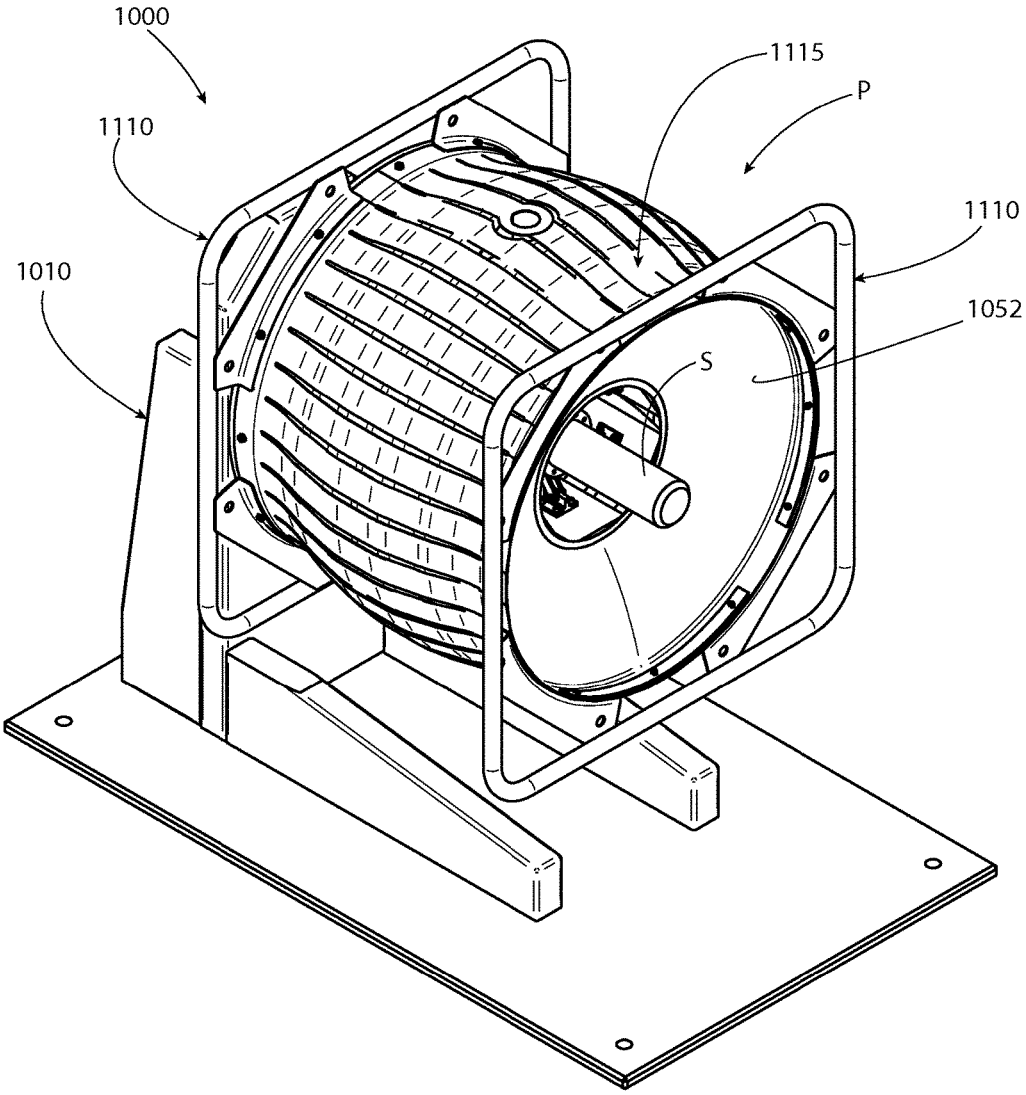
FIG. 15 is a perspective view similar to FIG. 14 showing removal of the end form retainer from the exposed end of the shaft.

With reference to FIGS. 15-16, with coil cover 1115 and end frames 1110 attached, the welding wire coil package P is complete and self supporting allowing coil C to be removed from mandrel M. To that end, mandrel M is retracted radially inward allowing the welding wire coil package to be slid off shaft S and removed from stand. The cantilevered position of package P on stand 1010 facilitates this removal. To remove the package P, retainer 1055 is removed from shaft S. A lifting device may be used to take the weight of the package before retracting mandrel M. With the mandrel M retracted, package P is moved axially outward to clear shaft S. Package P (FIG. 16) may then be placed on pallet or other supporting surface for shipment or shipped in the configuration shown.

Figure 17:
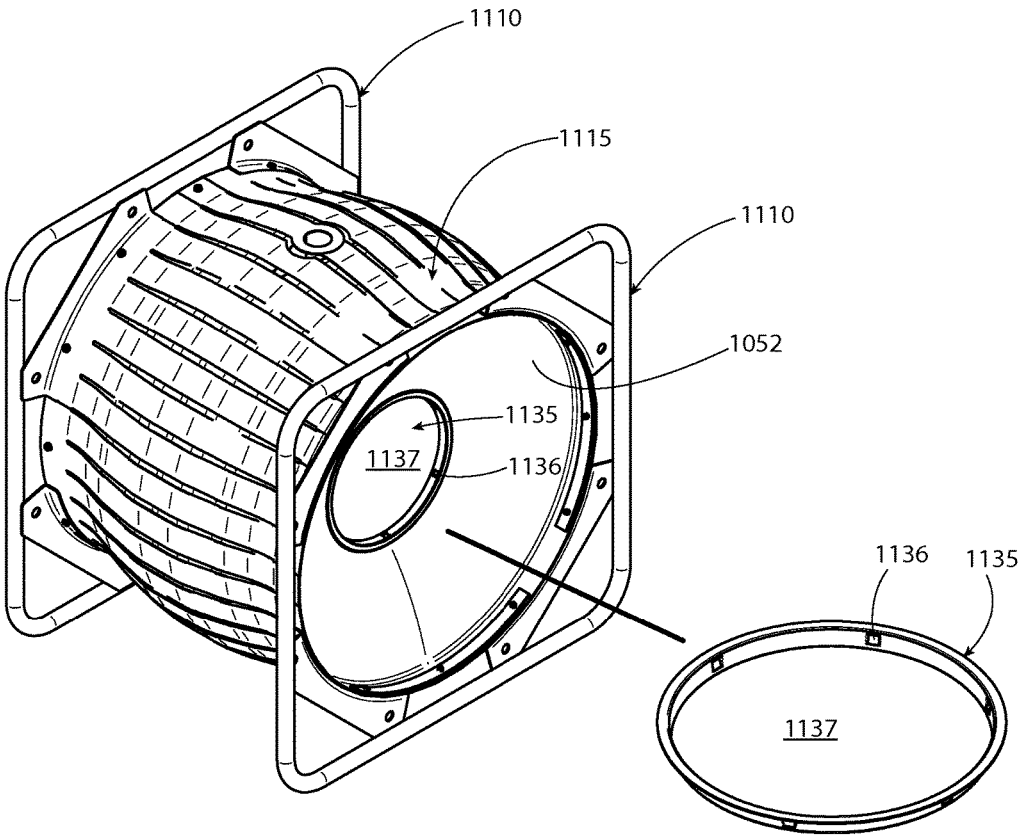
FIG. 17 is an enlarged perspective view of one end of package showing installation of a coil bore cover.

FIG. 16 shows the welding wire coil package removed from mandrel M. With the mandrel M removed, the bore 1130 defined by end forms may be closed by bore covers 1135. Bore covers 1135 may include clear plastic covers that have cover retainers 1136 including but not limited to detents, tabs, or other prongs that extend into the bore 1135 and engage the inner edge of end form to hold the cover 1135 in place. Plural cover retainers 1136 may be circumferentially spaced about cover 1135. It will be understood that cover 1135 shown conforms to bore 1130 defined by end forms, which are circular, but other shapes may be used. The conforming shape is provided to close the bore at each end to prevent contaminants from entering the coil C during shipment or handling. Additionally, opaque covers may be used in place of the clear covers. Clear covers, such as the embodiment shown, provide a window 1137 that allow the user to observe the interior of the coil C. FIG. 17 shows the package P with covers 1135 installed and ready for shipment.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., enclosures, sides, components, assemblies, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed:

1. A wire coil packaging system comprising:

a process stand having an upright, the upright defining a hub receiver;

a cartridge including a shaft having a hub at one axial extremity, the hub being received in the hub receiver with the cartridge cantilevered from the upright the cartridge including a mandrel adapted to have a wire wound thereon in a coil;

a first end form at a first end of the cartridge;

a second end form at a second end of the cartridge opposite the first end;

at least one packaging component extending from the first end form to the second end form; and a yoke supported on the upright and located axially inward of the hub receiver, wherein a portion of the shaft sits within the yoke and is at least partially supported by the yoke, and wherein the shaft and hub are rotatable within the hub receiver and the yoke.

2. The wire coil packaging system of claim 1, wherein the first end form and second end form have the same shape.

3. The wire coil packaging system of claim 1, wherein the first end form and the second end form are frusto-conical members each defining a central opening that fits over an edge of the mandrel.

4. The wire coil packaging system of claim 1, wherein the first end form is located adjacent to the hub and the second end form is bound by a retainer.

5. The wire coil packaging system of claim 1, wherein the first and second end forms each include at least one end frame attachment assembly supported thereon, and the system further includes a first end frame attachable to the first end form and a second end frame attachable to the second end form, the first and second end frames adapted to extend outward of a coil of wire on at least one side.

6. The wire coil packaging system of claim 5, wherein the first end frame and second end frame have the same shape and adapted to define an opening larger than the coil, wherein the first end frame and second end frame are attached to the end frame attachment assemblies by gussets that extend inward from the end frame and are fastened to the end frame attachment assemblies by a fastener.

7. The wire coil package of claim 6, wherein the end frames have four frame members arranged to form a square shape and each end frame is attached to respective end forms by the gussets, the gussets having a curved interior surface adapted to conform to a surface of the end form attachment assembly, and wherein each gusset includes an outer surface that spans a corner of the square end frames attaching to two adjacent frame members.

8. The wire coil packaging system of claim 1, wherein the packaging component includes a cover including plural packaging segments attached to each of the first and second end forms and adapted to extend axially over a coil of wire, where the plural packaging segments are successively attached in different radial positions adapted to cover the coil.

9. The wire coil packaging system of claim 1, wherein the packaging component includes plural slats attached to the first and second end forms and successively arranged about a circumference of the end forms.

10. The wire coil packaging system of claim 1, wherein the packaging component adapted to cover a coil of wire and define an opening aligned with an end of the coil of wire.

11. The wire coil packaging system of claim 1 further comprising a first end cover and a second end cover attachable to the first end form and second end form after removal of the shaft therefrom, wherein the first end cover covers a first opening in the first end form and the second end cover covers a second opening in the second end form.

12. The wire coil packaging system of claim 11, wherein at least one of the first end cover and second end cover are transparent.

13. A wire coil packaging system comprising:

a process stand having an upright, the upright defining a hub receiver;

a cartridge including a shaft having a hub at one axial extremity, the hub being received in the hub receiver with the cartridge cantilevered from the upright, the cartridge including a mandrel;

a first end form at a first end of the cartridge;

a second end form at a second end of the cartridge opposite the first end;

at least one packaging component extending from the first end form to the second end form;

wherein the first end form is located adjacent to the hub and the second end form is bound by a retainer;

wherein at least an end of the shaft extending beyond the second end form is threaded, and wherein the retainer includes a hat that fits against the second end form and a collar that threadably attaches to the shaft.

14. The wire coil packaging system of claim 13 further comprising a yoke supported on the upright and located axially inward of the hub receiver, wherein a portion of the shaft sits within the yoke and is at least partially supported by the yoke, wherein the shaft and hub are rotatable within the hub receiver and the yoke.

15. A wire coil packaging system comprising:

a process stand having an upright, the upright defining a hub receiver;

a cartridge including a shaft having a hub at one axial extremity, the hub being received in the hub receiver with the cartridge cantilevered from the upright, the cartridge including a mandrel;

a first end form at a first end of the cartridge;

a second end form at a second end of the cartridge opposite the first end;

at least one packaging component extending from the first end form to the second end form; and a lift device having a first member attachable to the hub and extending radially outward, a second member extending axially inward from the first member, wherein the second member includes at least one hoist receiver.

16. The wire coil packaging system of claim 15, wherein the hoist receiver defines an elongated slot with a pair of notches extending upward from the slot and axially spaced from each other, the pair of notches forming a first hooking point and second hooking point.

17. The wire coil packaging system of claim 16, wherein a link is received in the slot and moveable between the first and second hooking points.

18. The wire coil package of claim 15, wherein the hub includes a pair of recesses on opposite sides thereof, and the first member includes a pair of tines extending downward on either side of the hub and at least partially received within the recesses, and a cross member attachable to the tines below the shaft to secure the first member to the hub.

19. A wire coil packaging system comprising:

a process stand having an upright, the upright defining a hub receiver, the upright including a yolk supported on the upright and spaced axially inward therefrom, and a cartridge including a removable shaft having a hub at one axial extremity, the hub being received in the hub receiver and at least partially supported on the yolk, a mandrel mounted on the shaft between a pair of end forms, the mandrel having an expanded position adapted to receive a wire thereon to form a coil that is open at each end, the end forms each defining an opening sized to fit over an end of the mandrel in the expanded position, and wherein the mandrel has a retracted position where the mandrel contracts to allow removal of the mandrel through an opening in one of the end forms; and a packaging element including a frame attachable to the end forms to support the coil after the mandrel and shaft are withdrawn.

20. The wire coil packaging system of claim 19, wherein the packaging element includes plural slats attached to the end forms and extending over the coil to at least partially cover the coil, and the frame includes a first frame member supported on one of the pair of end forms and a second frame member supported on the other of the pair of end forms, the first frame member and second frame member extending outward of the coil on at least one side of the coil, wherein at least one of the first frame member and the second frame member define an opening sized to allow the first frame member to be slid over the coil while it is supported on the upright.

* * * * *